United States Patent [19]

Hill

[11] 4,442,383

[45] Apr. 10, 1984

[54] PLASMA SWITCH

[76] Inventor: Alan E. Hill, Box 5444A, Rte. 5, Albuquerque, N. Mex. 87123

[21] Appl. No.: 355,894

[22] Filed: Mar. 8, 1982

[51] Int. Cl.[3] ..... H01J 11/04

[52] U.S. Cl. ..... 315/349; 315/326; 315/362; 315/111.81; 313/231.41; 313/362.1

[58] Field of Search ..... 315/326, 334, 111.8, 315/362, 347–349; 313/231.4, 359–362, 349

[56] References Cited

U.S. PATENT DOCUMENTS

| | | | |
|---|---|---|---|
| 3,137,820 | 6/1964 | McFarland | 313/362.1 |
| 3,760,225 | 9/1973 | Ehlers et al. | 315/334 |
| 3,956,666 | 5/1976 | Reader et al. | 315/111.81 |
| 4,019,079 | 4/1977 | Hardin | 313/231.41 |

OTHER PUBLICATIONS

"Development of a 100 KV Multimegawatt Rep Rate Gas Switch" by Allen Ramrus, IEEE Conference 1978, Thirteenth Pulse Power Modulator, (Jun. 20–22, 1978, Buffalo, N.Y.).

*Primary Examiner*—Harold Dixon

*Attorney, Agent, or Firm*—Donald P. Smith

[57] ABSTRACT

Apparatus for controlling the flow of high energy electrical pulses to a load using a switch having a plasma cathode which has rapid start up capability and requires no heater power.

13 Claims, 4 Drawing Figures

PLASMA SWITCH

BACKGROUND OF THE INVENTION (1) Field of the Invention

The invention relates to methods and apparatuses for controlling the flow of high energy electrical pulses to a load using a switch having a plasma cathode which has rapid start up capability and requires no heater power as does, for example, a conventional thyratron. The invention finds its application in those systems wherein short-time-duration high energy pulses are delivered to a load, for example, ion engines, radar systems, lasers, particle accelerators, and those electromagnetic pulse testing systems which simulate the electromagnetic fields developed in a nuclear explosion.

(2) Description of the Prior Art

Various high energy short-time-duration pulse controlling systems are known in the art. Gas tubes and vacuum tubes are usually depended upon for their operation.

High vacuum tubes (hard tubes) rely on the well known thermoionic emission from a cathode which produces a limited number of charge carriers (no ions). The obtainable current density is limited by an electron space charge at the cathode; however, the advantage is that no ions exist to form a positive space charge around the control grid when it is pulsed negative. Hence, hard tubes may be turned on and off, even in the condition of current flow.

Gas-filled tubes generate their charge carriers from ionizing electron-molecule collisions which produce an electrically neutral plasma with electrons and positive ions moving in opposite directions. Conduction may be held off by a control grid in the absence of current flow, but once switched on, the ions form a space charge around any grid which tries to go negative so that its controlling electric field is cancelled. This results in an out of control arc. The gas filled tubes provide on-switching capability of almost unlimited currents, but must be externally turned off until recombination dissipates the plasma. Only then may the control grid hold-off function be re-established. Statistical ionization processes can also be important when jitter requirements are severe, or when trigger-to-breakdown times must be 0.5 μsecond or less. Recent use of hydrogen and grounded-grid designs have shortened conventional thyratron ionization and deionization times, but hydrogen clean up presents a problem, and heated reservoirs are needed to attempt to maintain a suitable equilibrium operating pressure over the tube's lifetime.

The switch described herein offers and major advantages of both hard tubes and thyratrons. It yields kilohertz repetition capability, high power handling, high voltage hold off, nanosecond rise time, and has an impedance distribution to match any transmission line geometry. It suffers none of the thermionic limitations characteristic of hard tubes.

Reference is made to the following works for those relationships, equations, and definitions which are used hereinafter:

*Gaseous Conductors—Theory and Engineering Applications,* James D. Cobine PhD., Dover Publications Inc. 1958 edition.

*Basic Data of Plasma Physics,* Sanborn C. Brown, M.I.T. Press 1959 edition.

*Continuous Uniform Excitation of Medium Pressure $CO_2$ Laser Plasmas by Means of Controlled Avalanche Ionization,* Alan E. Hill, Applied Physics Letters, vol. 22, no. 12, June 1973.

SUMMARY OF THE INVENTION

The invention relates to a method and an apparatus for controlling the flow of high energy short-time-duration pulses to a load.

It is, accordingly, an object of the invention to provide a circuit for use in an energy pulse system.

It is another object of the invention to provide a circuit for use in an energy pulse system including a plasma switch.

It is yet another object of the invention to provide a plasma switch having high repetition capability, high power handling ability and a nanosecond current rise time.

It is yet still another object of the invention to provide a plasma switch having three descrete regions, a first region to contain plasma, a second region having a plurality of grid structures, and a third region having an element to conduct energy to a load.

BRIEF DESCRIPTION OF THE DRAWINGS

A detailed description of the invention will be made with reference to the accompanying drawings wherein like reference characters designate like, or corresponding parts in the several figures.

DESCRIPTION OF PREFERRED EMBODIMENTS

Figure 1:
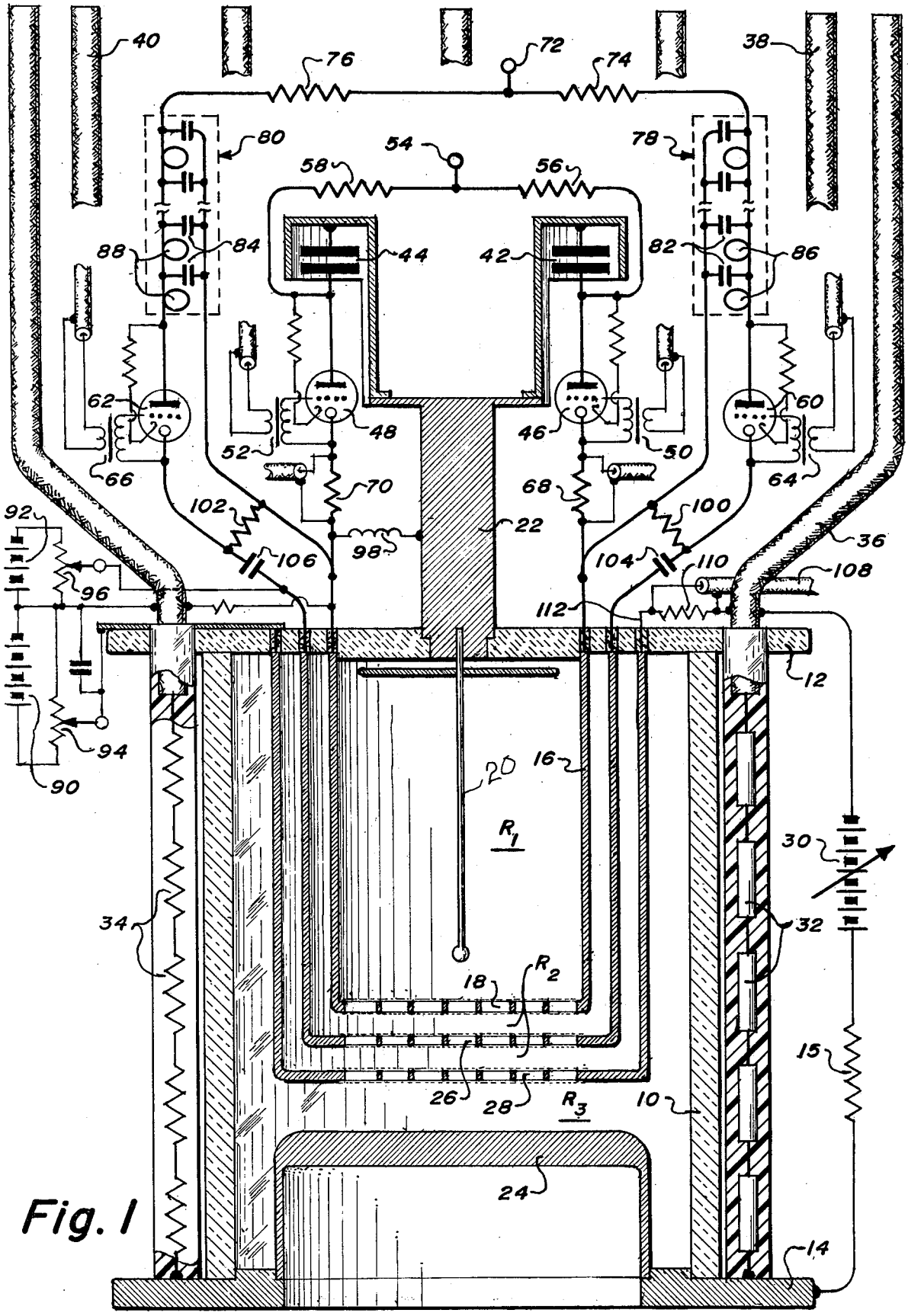
FIG. 1 shows, partly in elevation and part diagrammatically, a switch and its associated circuitry in accordance with the invention.

The following detailed description is of the best methods, and structures, and modes of carrying out the invention. The description is not to be taken in a limiting sense, but is made for the purpose of illustrating the general principles of the invention. The scope of the invention is defined by the appended claims.

Reference is here made to U.S. Patent Office Disclosure Document Ser. No. 100,464 registered on June 4, 1981, which reveals evidence of the conception and actual reduction to practice of the invention disclosed and claimed herein.

The embodiments of the invention to be hereinafter described will reveal that the conducting plasma can be spatially distributed over any desired cross-sectional area, which leads to very high power handling capability and the ability to configure an impedence match into any size or shape transmission line.

As hereinafter used the following definitions are offered:

Plasma: An assembly of ions, electrons, neutral atoms, and molecules in which the motion of the particles is dominated by electromagnetic interactions. A plasma is effectively neutral. Thus, there are equal numbers of positive and negative charges in every macroscopic volume of a plasma. A plasma is a conductor and interacts with electromagnetic fields.

Townsend Ionization: An increase in current in a discharge occurs when electrons have gained enough energy to ionize neutral atoms by collision, and a rapid current increase occurs when the electrons produced by electron collision gain sufficient energy to produce additional ionization. Stated differently, an increase in current in a gaseous electric discharge (plasma) caused by separation of neutral atoms or molecules into ion-electron pairs by collisions with electrons of sufficient energy. This cannot occur unless the electric field and gas density conditions allow electrons to gain a critical level of kinetic energy, on the average, per collision. When this condition is met an exponential increase in ion-electron pair density results due to a chain reaction effect. (Cobine pags. 143–147)

The Production Rate of electron ion pairs throughout a gas volume due to electron-neutral inelastic collisions is:

$$\partial n_e/\partial t = \alpha_\tau v_d P n_e - \alpha_r n_e^2$$

where P is the pressure (Torr), $\alpha_\tau$ is the reduced Townsend coefficient, and $v_d$ is the electron drift velocity ($v_d \simeq 10^7$ cm/sec and $\simeq 0.9$ ions pairs/sec in helium while $E/P \geqq 15$ V/cm Torr). (See Alan E. Hill, Applied Physics Letters).

Pashen Breakdown Law: The discharge potential is a function of the product of pressure and gap length. In a practical sense, and in application to a physical structure this means that when the physical dimensions of cathode-anode separation and the pressure is selected so that such separation is not large compared to the distance between ionizing collisions, then Townsend avalanching ionization cannot occur. The loss mechanisms dominate over the production mechanisms because the collision frequency cannot produce enough ionization to overcome losses. (Cobine pgs. 163–165).

Figure 2:
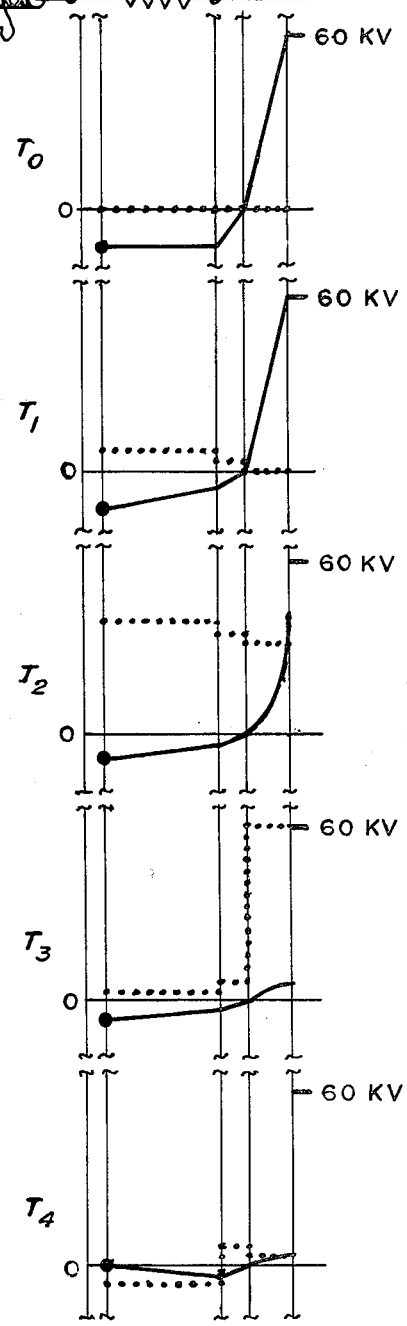
FIG. 2 is a graph showing the relationship between voltage and gap spacing for different pressures in accordance with Paschen's Law.
Figure 2:
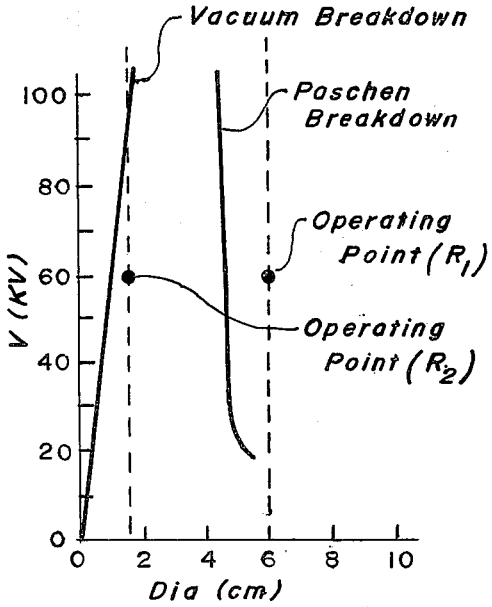

Referring now to FIG. 1, wherein like parts are designated by like reference characters, there are shown three descrete regions designated $R_1$, $R_2$ and $R_3$. In general, in region $R_1$, the plasma cathode region, a neutral, volume-ionization controlled plasma is formed by Townsend avalanche multiplication. Ionization within region $R_3$ is prevented by operating with dimensions and pressures where Paschen's Law controls, as is shown in the relationship of FIG. 2. As an example, within the correct pressure range, potentials as low as 400 volts will result in Townsend Ionization in $R_1$ while very high potentials (180 KV) may be held off in $R_3$ by spacing the field gradient small enough to prevent avalanche multiplication. Then, for a switching operation when the grids in region $R_2$ are pulsed and a sea of plasma exists in $R_1$, electrons are plucked from the plasma as current carriers across the switch gap $R_3$.

In the drawing of FIG. 1 certain circuit elements which serve the switch are shown in duplicate merely to enhance the operation of the switch in the actual reduction to practice of the structure. A cylindrical housing 10, made from an insulating material, has a top member 12 and a conducting base 14. The housing surrounds the elements comprising the switch. Pressure control means (not shown) are provided and depended upon to provide and maintain pressure, other than ambient within the housing at a level depending on the application of the structure. Means may also be provided to exchange the gas volume at high speed to remove contaminants thereby extending the repetition rate and the useful life. As an example a pressure of 50 microns of helium has been used in a practical application of the structure disclosed. The pressure is not necessarily critical in that the switch operated with slightly different characteristics over a range of 40–80 microns of helium. This parameter, of course, may be varied depending on the application and the geometry of the switch. Cylindrical cathode 16 having a perforated base 18 and a wire 20 held by member 22 at the axis of symmetry of the cathode is fixed to top member 12 for the purpose of electrostatically lengthening the electron mean free path. Anode 24 is secured and connected to base member 14. Grids 26 and 28 are disposed between the cathode and anode. The load, comprising a plurality of series connected resistors is shown by reference characters 32 and 34. A group of identical open ended metal sheathed coaxial cables 36, 38, 40 are each connected at one end thereof to load resistors 32 and 34. The cables serve as a pulse forming circuit and have charging source 30 (60 KV) connected to each respective outer metal sheath and a charging resistor 15 connected to base member 14 to pre-charge the cables.

The plasma forming circuit comprises condensers 42 and 44 and krytron tubes 46 and 48 having grid triggering circuits shown generally as 50 and 52 each connected to a high voltage source 54 through resistors 56 and 58.

Krytron tubes 60 and 62 having triggering circuits 64 and 66 are responsive to current through resistors 68 and 70 to sense the presence of plasma in region $R_1$ to pulse triggering circuits 64 and 66. High voltage source 72 is connected to pulse-forming circuits 78 and 80 through resistors 74 and 76. The pulse-forming circuits comprise a plurality of parallel connected capacitors 82 and 84 and series connected one-turn inductance coils 86 and 88.

Energy sources 90 and 92 each having a voltage divider circuit 94 and 96 are connected to provide bias voltage for grids 26 and 28.

A high inductance coil 98 is connected to maintain the cathode circuit at uniform potential but its reactance is so extremely high that it is an open circuit when conduction occurs.

Load resistors 100 and 102 for the pulse forming circuits 78 and 80 and isolating condensers 104 and 106 are connected as shown. A current probe 108 for test purposes is connected across resistor 110.

The connections for main load current flow when the main pulse forming circuit (36–40) has been charged and the field collapses when the switch conducts, is resistor 110, conductor 112, grid 28 across gap $R_3$ to anode 24, base 14, load 32 and 34 back to the pulse forming circuit.

The structure and circuitry shown exactly reproduces the function of, for example, controlling the connection of a laser fast energy pulse storage network to a load. In the operation of the assembly of FIG. 1 the main pulse forming network cables 36–40 are pre-charged by energy source 30 through charging resistor 15. Condensers 42, 44, 82 and 84 are also pre-charged thus forming an electric field for plasma formation in cathode 16.

When the switch is to conduct, the grids of tubes 46 and 48 are pulsed by their pulsing circuits 50 and 52 thereby connecting condensers 42 and 44 to the plasma cathode 16. Plasma is formed in region $R_1$. The plasma sensing circuits 68 and 70 sense the formation of the plasma by responding to current therethrough and apply voltage pulses to the grids of tubes 60 and 62. This action pulses grids 26 and 28 and makes region $R_3$ conducting thereby completing the load circuit described previously.

This switch incorporates the important characteristics which are usually distributed between thyratrons, hard tubes, and spark gaps. The conducting plasma can be distributed over any cross-sectional area leading to a good impedence match into any size or shaped transmission line even for low impedence geometries.

In the switching operation described, the control grids are free of space charge even during current conduction and continue to operate in hard tube fashion, yet the switch does not suffer from the thermionic limitations of hard tubes.

In order to switch large currents it is necessary to allow a neutralizing positive charge to enter $R_3$. To operate in this mode both grids 26 and 28 are pulsed hard. Then, as enough negative space charge develops between the grids to negate their electric fields, positive ions are pulled from the plasma into the main gap $R_3$. This reduces the potential drop across the gap which could occur and it falls to its inductance limited value plus cathode fall. In this mode of operation we relinquish grid control.

In the application of the switch to different circuits there are different modes of operation available to one skilled in the art. For example, the plasma cathode may be powered and the grid may be pulsed simultaneously without creating a serious jitter problem. This enables the switch to be operated with a single energy pulse.

If the switch is to be used in a circuit which remains or floats above ground potential the plasma energy may be drawn from the main source pulse forming network. If the switch is to be used in a grounded circuit the plasma energy is drawn from a second source, but a single signal or pulse is still relied upon to power the cathode and pulse the grid. In both cases a hydrogen thyratron is used to control the switch by pulsing the grid.

Figure 3:
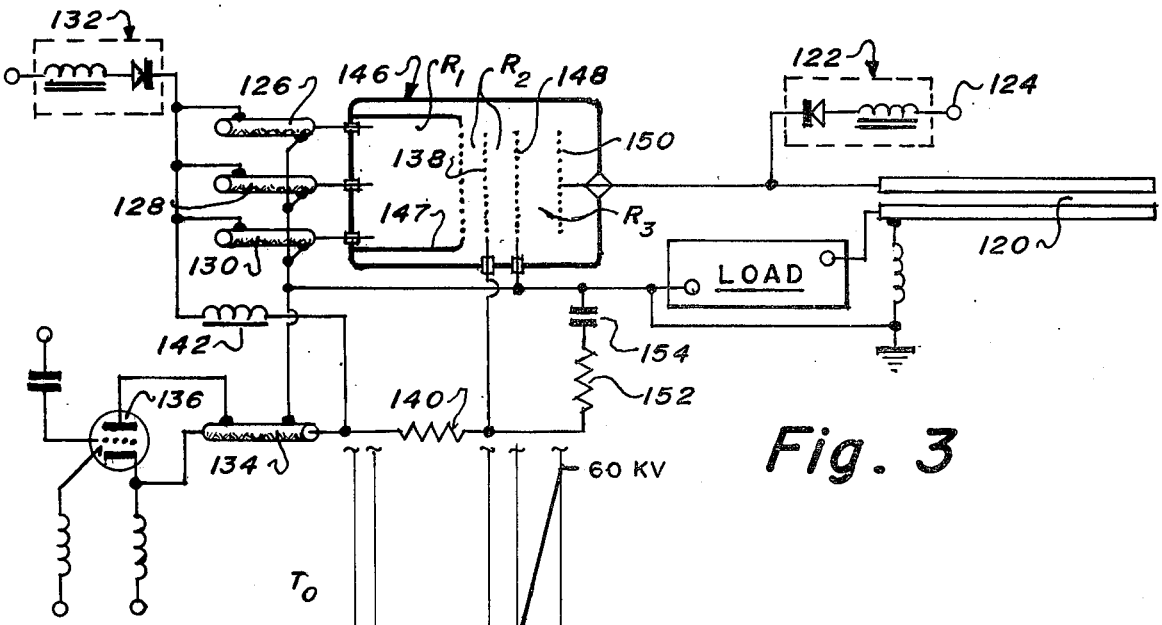
FIG. 3 is a schematic diagram of the circuit of the invention in grounded mode with associated pulse shapes at differing times.

FIG. 3 shows switch operating and voltage and current characteristics in a circuit for switching a Blumlein Line or other load to ground. In FIG. 3 reference character 120 indicates a Blumlein Line or Laser Fast Storage circuit to be connected to ground through a load. A high voltage source, 60 KV to charge the line through circuit 122 is connected to terminal 124. A group of identical metal sheathed coaxial cables 126, 128 and 130 serve as a pulse forming circuit for the cathode and have a charging circuit 132 connected to each respective sheath to form an electric field for plasma formation in region $R_1$. Grid pulse storage cable 134 is connected to thyratron 136, to cables 126, 128 and 130 and to grid 138 through resistor 140. Blocking inductance coil 142 is connected so that the cathode pulse forming cables and the grid storage cable track during the voltage rising charging phase but will act as an open circuit for a $5\times10^{-8}$ second pulse.

The switch, per se, comprises envelope 146, cathode 147, control grid 138, screen grid 148, and anode 150 connected to Blumlein Line 120.

As in the previous example the Blumlein Line (or main energy storage), the cathode pulse forming cables, and the grid storage cable are all charged. The grid storage cable is opposite in polarity to the cathode cables. As the grid and cathode potentials rise their potential difference remains near zero and no plasma is formed. A large potential gradient forms between grids 138 and 148 because grid 148 is connected to ground potential and the anode rises to the full 60 KV potential as the Blumlein Line becomes charged. However, neither region $R_1$ or $R_2$ breaks down since they fall into the forbidden regions of the Paschen curve of FIG. 2. The circuit is now in condition for the switching function and may be triggered by removing the shielding effect of grid 138. This is done by firing the thyratron 136 which shorts the end of the grid pulse storage cable. Since the cable was charged to negative polarity this shorting launches a positive pulse (+V) which travels to the cable end after time L/C, then reflects twice thus generating a pulse (+V/2) lasting time 2L/C. This pulse is blocked by coil 142 and therefore swings the polarity of grid 138 positive with respect to the cathode 147. This would also tend to pulse grid 148 positive but this is undesirable because it would inhibit complete conduction of the plasma to the anode and because a lingering negative bias is desirable to dissipate any space charge after conduction. The shift in potential is achieved by providing a voltage divider 140, resistor 152 and capacitor 154. The reactance of the capacitor is selected so that it is zero during the pulsing time but infinite during the charging time.

Referring now to the time-sequence curves appearing directly below the elements of the switch in FIG. 3, wherein the dotted line represents current and the solid line represents voltage. At time $T_o$ there is no potential gradient in region $R_1$ and although the potential gradient is steep in regions $R_2$ and $R_3$ plasma does not form. At $T_1$ a potential gradient develops in region 1, plasma forms in that region and plasma current rises as the cables are discharged. At time $T_2$ electrons are being pulled into $R_3$ and a negative space charge develops. As the field between grids 138 and 148 is nullified by space charge, positive ions are pulled from the plasma into $R_3$. At time $T_3$ space charge has been neutralized, the electric field in $R_3$ has collapsed and main source current is in full conduction. At time $T_4$ all of the stored energies are dissipated but negative grid bias voltages are maintained and negative swings occur on the anode due to, possibly, main circuit impedance mis-matches. However, this helps drain the ionization.

Figure 4:
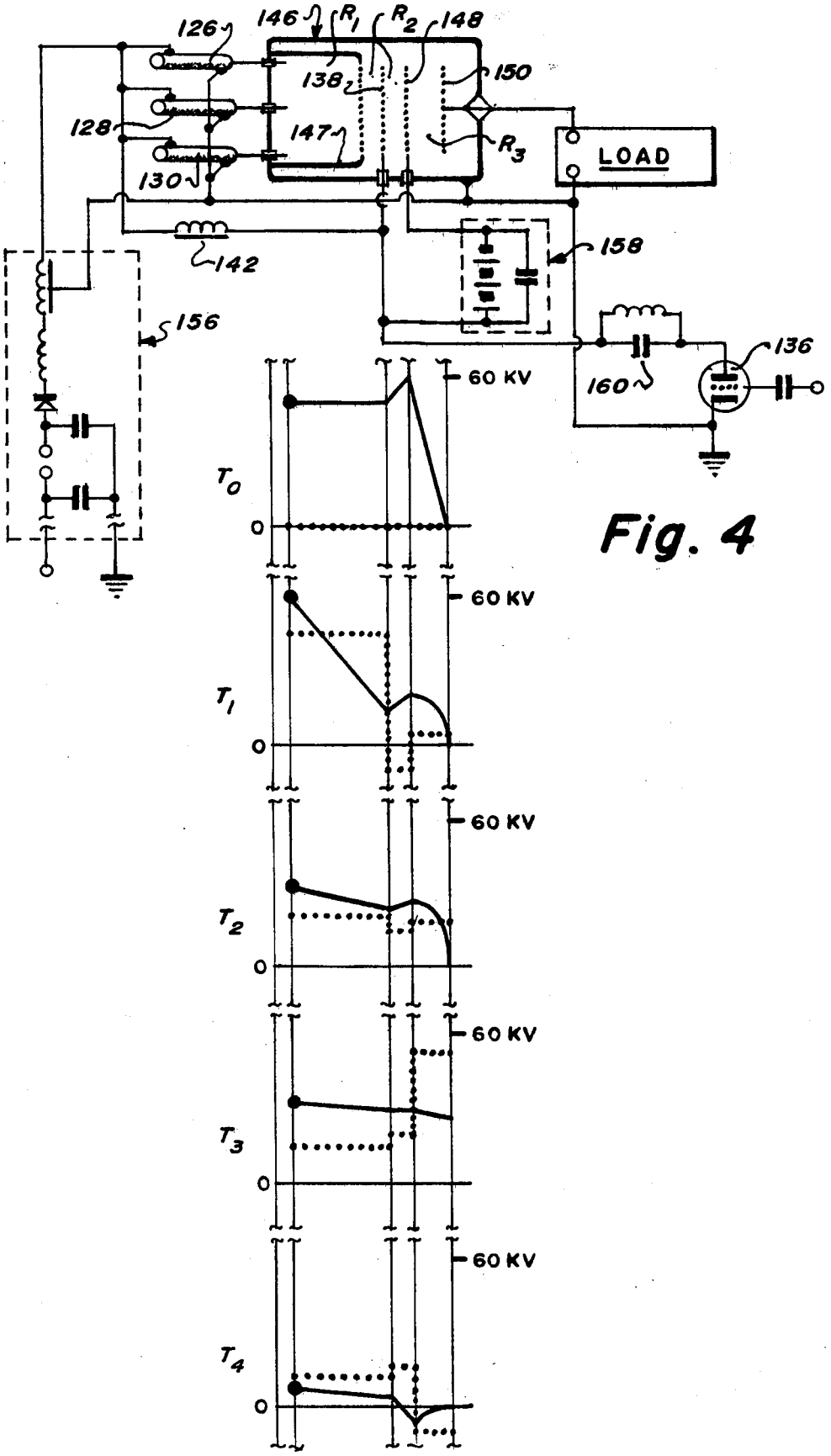
FIG. 4 is a schematic diagram of the circuit of the invention in the ungrounded or floating mode with associated pulse shapes at differing times.

When the switch is to be applied in a circuit where both ends of the switch are to remain above ground potential the circuit and current and voltage characteristics of FIG. 4 are applicable. Since the switch is structurally identical to the switch of FIG. 4 the same reference characters are used therein for identical parts except that the element 147 is now connected as an anode and element 150 is used as the cathode. Control grid 138 is biased in a positive sense to retain positive ions in the plasma region $R_1$.

In this application the power for the plasma generation is drawn from a laser power supply shown generally as 156.

Element 147 (now anode) rides at the laser power supply potential and grid 138 is maintained at the same potential through inductive reactance coil 142. Grid 148 is back biased in a positive sense by means of a separate energy source 158. This helps isolate the several regions prior to breakdown and provides rapid ionization bleed following breakdown. The voltage and current status chart appearing under the switch shows the initial voltage distribution in the switch at time $T_o$. To fire the switch the thyratron 136 is fired and the pulse through circuit 160 drops the potential of grid 138 and the voltage and current distribution appear at time $T_1$. Plasma is formed in region $R_1$ and the plasma current rises as the cables 126, 128 and 130 are discharged. At time $T_2$ electrons are being pulled into region $R_3$ and a negative space charge develops. As the field between grids 138 and 148 is nullified by space charge, positive ions are pulled from the plasma into region $R_3$. Time $T_3$ shows the point where space charge has been neutralized, the electric field in region $R_3$ has collapsed, and main source current is in full conduction. As in the previous application time $T_4$ illustrates the condition where the stored energies are dissipated but negative bias voltages are maintained.

It will be apparent to those skilled in the art that many changes may be made in the construction and arrangement of parts, for example the switch may be configured as a cylinder, an annulus or a linear strip without departing from the scope of the invention as defined in the appended claims.

I claim:

1. A circuit for use in an energy pulse system including a plasma switch to selectively conduct current pulses between an energy source and a load, said circuit having first, second, and third states, said circuit in its first state being adapted to render said plasma switch non-conductive, in its second state to form a plasma within a restrained volume in said switch, and in its third state to render said plasma switch conductive.

2. The invention of claim 1 wherein the said plasma switch comprises:

a. a housing having three descrete regions, b. a first regions adapted to contain plasma and having dimensions and pressures to induce Townsend Ionization, c. a second region having a plurality of grid elements to selectively hold off or permit energy flow, d. a third region having an element therein to conduct energy to the load and having pressure and dimensions to prevent ionization pursuant to Paschen's Law and, e. means to maintain pressure lower than ambient within said housing.

3. The invention of claim 2 wherein the production rate of electron ion pairs in the Townsend Ionization is:

$$\partial n_e/\partial t = \alpha_r v_d P n_e - \alpha_r n_e^2.$$

4. The invention of claim 3 wherein said circuit comprises a first electrical network connected to form plasma in said restrained volume, a second network connected to sense the development of said plasma, and a third network connected to said second network and responsive thereto to initiate plasma flow from said restrained volume to render the switch conductive.

5. The invention of claim 1 wherein said plasma switch comprises a plasma cathode, a first grid structure positioned adjacent said plasma cathode to control plasma flow, a second grid structure positioned adjacent said first grid structure to dissipate space charge after plasma conduction, and an anode to conduct load current.

6. The invention of claim 5 including a circuit to sense the formation of plasma in said plasma cathode.

7. The invention of claim 6 wherein the said plasma cathode is cylindrical and includes means disposed at its axis of symmetry to electrostatically lengthen the electron mean free path.

8. A plasma switch for use in controlling the flow of short time duration energy pulses to a load and having high repetition capability, high power handling ability, and nanosecond voltage rise time comprising plasma forming means, plasma flow controlling means, and means to conduct the load energy.

9. A plasma switch for use in controlling the flow of short-time-duration energy pulses to a load and having high repetition capability, high power handling ability and nanosecond voltage rise time comprising:

a. a housing having three descrete regions, b. a first region adapted to contain plasma and having dimensions and pressures to induce Townsend Ionization, c. a second region having a plurality of grid elements to selectively hold off or permit energy flow, d. a third region having an element therein to conduct energy to the load and, e. means to maintain pressure other than ambient within said housing.

10. The invention of claim 9 wherein the said first region comprises a cylinder having a wire fixed at its axis of symmetry to electrostatically lengthen the electron mean free path.

11. The invention of claim 10 wherein the said element in the said third region is an anode.

12. The invention of claim 11 wherein the production rate of electron ion pairs in the Townsend Ionization is:

$$\partial n_e/\partial t = \alpha_r v_d P n_e - \alpha_r n_e^2.$$

13. The invention of claim 12 wherein the said means to maintain pressure other than ambient within said housing includes means to introduce helium gas therein.

* * * * *